US009708694B2

(12) United States Patent
Jung et al.

(10) Patent No.: US 9,708,694 B2
(45) Date of Patent: Jul. 18, 2017

(54) METHOD FOR MANUFACTURING HIGH STRENGTH FLAKE GRAPHITE CAST IRON FOR AN ENGINE BODY AND FLAKE GRAPHITE CAST IRON FOR AN ENGINE BODY

(71) Applicant: DOOSAN INFRACORE CO., LTD., Incheon (KR)

(72) Inventors: Ki Hwan Jung, Gyeonggi-do (KR); Dong Seob Shim, Gyeonggi-do (KR); Sik Yang, Gyeonggi-do (KR); Jae Hyoung Hwang, Gyeonggi-do (KR)

(73) Assignee: Doosan Infracore Co., Ltd., Incheon (KR)

( * ) Notice: Subject to any disclaimer, the term of this patent is extended or adjusted under 35 U.S.C. 154(b) by 359 days.

(21) Appl. No.: 14/368,184

(22) PCT Filed: Dec. 7, 2012

(86) PCT No.: PCT/KR2012/010626

§ 371 (c)(1),
(2) Date: Jun. 23, 2014

(87) PCT Pub. No.: WO2013/094904

PCT Pub. Date: Jun. 27, 2013

(65) Prior Publication Data

US 2015/0027399 A1 Jan. 29, 2015

(30) Foreign Application Priority Data

Dec. 23, 2011 (KR) ..... 10-2011-0141028
Oct. 19, 2012 (KR) ..... 10-2012-0116687

(51) Int. Cl.
*C22C 33/04* (2006.01)
*C22C 33/08* (2006.01)
(Continued)

(52) U.S. Cl.
CPC ..... *C22C 33/08* (2013.01); *B22D 1/00* (2013.01); *B22D 25/02* (2013.01); *C21C 1/08* (2013.01);
(Continued)

(58) Field of Classification Search
CPC ..... C22C 33/08; C22C 33/04; C22C 37/10; C21C 1/08
See application file for complete search history.

(56) References Cited

U.S. PATENT DOCUMENTS 5,759,298 A * 6/1998 Williamson ..... F04C 2/025 148/321
6,395,107 B1 5/2002 Subramanian
(Continued)

FOREIGN PATENT DOCUMENTS

EP 0232042 A2 * 8/1987 ..... C21C 1/105
JP S4975412 A 7/1974
(Continued)

OTHER PUBLICATIONS

Search Report dated Apr. 8, 2013 and written in Korean with English translation for International Patent Application No. PCT/KR2012/010626 filed Dec. 7, 2012, 5 pages.
(Continued)

*Primary Examiner* — George Wyszomierski
*Assistant Examiner* — Tima M McGuthry Banks
(74) *Attorney, Agent, or Firm* — John D. Veldhuis-Kroeze; Westman, Champlin & Koehler, P.A.

(57) ABSTRACT

The present disclosure relates to a flake graphite cast iron simultaneously having high strength, good machinability, and fluidity, to a method for manufacturing same, and to an engine body comprising the flake graphite cast iron for an internal combustion engine and, more particularly, to a method for manufacturing a flake graphite cast iron, for an
(Continued)

engine cylinder block and head having improved castability, a low possibility of the occurrence of chill due to ferroalloy, stable tensile strength and yield strength, and good machinability by adding a trace of strontium in a cast iron including carbon (C), silicon (Si), manganese (Mn), sulfur (S), and phosphorus (P), which are five elements of the cast iron, molybdenum (Mo), a high strengthening additive, and copper (Cu) while controlling the ratio (S/Sr) of the sulfur (S) content to the strontium (Sr) content in the cast ion.

10 Claims, 10 Drawing Sheets

(51) Int. Cl.

| | |
|---|---|
| ***C22C 37/10*** | (2006.01) |
| ***C21C 1/08*** | (2006.01) |
| ***B22D 1/00*** | (2006.01) |
| ***C22C 37/04*** | (2006.01) |
| ***B22D 25/02*** | (2006.01) |
| ***C22C 37/00*** | (2006.01) |
| *F02F 7/00* | (2006.01) |

(52) U.S. Cl.
CPC ..... *C22C 33/04* (2013.01); *C22C 37/00* (2013.01); *C22C 37/04* (2013.01); *C22C 37/10* (2013.01); *C21C 2250/00* (2013.01); *F02F 7/0021* (2013.01); *F02F 7/0024* (2013.01)

(56) References Cited

U.S. PATENT DOCUMENTS

| | | | | |
|---|---|---|---|---|
| 2007/0023106 | A1* | 2/2007 | Lampic-Oplander ... | C22C 37/10 148/321 |
| 2008/0206584 | A1* | 8/2008 | Jaszarowski ..... | C22C 37/10 428/544 |

FOREIGN PATENT DOCUMENTS

| | | | |
|---|---|---|---|
| JP | 2002129276 | A | 5/2002 |
| JP | 2004-257422 | | 9/2004 |
| JP | 2007-527951 | | 10/2007 |
| KR | 10-2010-0031131 | | 3/2010 |
| WO | 2010091486 | A1 | 8/2010 |

OTHER PUBLICATIONS

European Search Report and Written Opinion mailed Feb. 17, 2016 for European Application No. 12859977.6, 11 pages.

* cited by examiner

METHOD FOR MANUFACTURING HIGH STRENGTH FLAKE GRAPHITE CAST IRON FOR AN ENGINE BODY AND FLAKE GRAPHITE CAST IRON FOR AN ENGINE BODY

CROSS-REFERENCE TO RELATED APPLICATION

This Application is a Section 371 National Stage Application of International Application No. PCT/KR2012/010626, filed Dec. 7, 2012 and published, not in English, as WO 2013/094904 on Jun. 27, 2013.

FIELD OF THE DISCLOSURE

The present disclosure relates to a method for manufacturing high-strength flake graphite cast iron, flake graphite cast iron manufactured by the method, and an engine body comprising the cast iron, and more particularly, to flake graphite cast iron capable of uniformalizing graphite shapes of a thin walled part and a thick walled part, reducing low possibility of the formation of chill and exhibiting high strength and excellent processibility by controlling a very small amount of sulfur (S) and a content of strontium (Sr) to be a predetermined ratio even though ferroalloy is added to achieve high strength, and a method for manufacturing the same.

BACKGROUND OF THE DISCLOSURE

In recent years, as environmental regulations are tightened, it is necessary to reduce contents of environment pollutants discharged from an engine, and in order to solve the pollutant discharge, it is necessary to increase a combustion temperature by increasing an explosion pressure of the engine. In this way, when the explosion pressure of the engine is increased, strength of engine cylinder block and head constituting the engine needs to be increased in order to stand the explosion pressure.

A material that is currently used for the engine cylinder block and head is flake graphite cast iron to which a very small amount of ferroalloy such as chrome (Cr), copper (Cu), or tin (Sn) is added. Since the flake graphite cast iron has excellent heat conductivity and excellent damping ability and a very small amount of ferroalloy is added thereto, the flake graphite cast iron is less likely to occur chill, and has excellent castability. However, since tensile strength is about 150 to 250 MPa, there is a limitation in using the flake graphite cast iron for the engine cylinder block and head requiring an explosion pressure of more than 180 bar.

Meanwhile, the material of the engine cylinder block and head for standing the explosion pressure of more than 180 bar needs to have a high strength of about 300 MPa. To achieve this, an element such as copper (Cu) or tin (Sn) for stabilizing pearlite or an element such as chrome (Cr) or molybdenum (Mo) for prompting generation of carbide needs to be added. However, since the addition of the ferroalloy may potentially cause the occurrence of the chill, there is a problem in that the chill is highly likely to be caused in thin walled parts of engine cylinder block and head having a complicated structure.

As the related art for achieving high strength of the flake graphite cast iron, there is a method of forming MnS emulsion by controlling a using ratio between manganese (Mn) and sulfur (S) added in a molten cast iron, that is, Mn/S to be a predetermined ratio. At this time, the formed Mn/S emulsion serves to prompt generation of the nucleus of graphite and to reduce the occurrence of the chill due to the addition of the ferroalloy. Since the aforementioned method can be applied to high manganese molten cast iron having a manganese (Mn) of about 1.1 to 3.0%, the content of the manganese (Mn) needs to be used two times more than a content of manganese used in manufacturing flake graphite according to the related art. Thus, material cost may be unavodiably increased. Further, the manganese (Mn) serves to prompt a pearlite structure, and allows a cementite distance within the pearlite structure to be densed to strengthen a matrix structure. However, when a large quantity of manganese (Mn) is added, since carbide is stabilized to disturb growth of the graphite. Accordingly, when the Mn/S ratio is not controlled to be a predetermined range, the occurrence of the chill is further prompted due to the large content of the manganese. Therefore, there is a limitation in applying the flake graphite cast iron to the engine cylinder block and head having a complicated structure.

CGI (compacted graphite iron) that has excellent castability, damping ability and heat conductivity of the flake graphite cast iron and satisfies a high tensile strength of 300 MPa or more is recently applied to engine cylinder block and head having a high explosion pressure. In order to manufacture the CGI of a tensile strength of 300 MPa or more, it is necessary to use a melting material and pig iron in which a content of an impurity such as sulfur (S) or phosphorus (P) is low, and it is necessary to precisely control magnesium (Mg) which is an element of spheroidizing the graphite. However, since it is difficult to control the magnesium (Mg) and the CGI is very sensitive to changes of melting and casting conditions such as a tapping temperature and a tapping speed, it is highly likely to cause material quality deterioration of the CGI and casting defect. Further, manufacturing cost may be increased.

Moreover, since the CGI has relatively poor processibility than the flake graphite cast iron, when the engine cylinder block and head are manufactured using the CGI, it is difficult to manufacture the engine cylinder block and head in an existing processing line for the flake graphite cast iron, and it is necessary to change the processing line to a processing line for the CGI. Accordingly, enormous facility investment cost may be incurred.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

In order to solve the aforementioned problems, an embodiment of the present disclosure is to provide flake graphite cast iron which simultaneously has high strength and excellent processibility and fluidity even though ferroalloy such as molybdenum (Mo) or copper (Cu) is added to achieve high strength by controlling a content of strontium (Sr) among a very small amount of components added in cast iron and a content ratio between sulfur (S) and strontium (Sr) to be in a predetermined range, and a method for manufacturing the same.

An embodiment of the present disclosure is to also provide cast iron having a stable property and structure by precisely controlling a using ratio between sulfur and strontium, and more particularly, to provide flake graphite cast iron capable of being applied to an engine body for an internal combustion engine having a complicated shape, preferably, an engine cylinder block and/or an engine cylinder head.

An exemplary embodiment of the present disclosure provides a method for manufacturing high-strength flake graphite cast iron. The method comprises (i) manufacturing molten cast iron that includes 3.2 to 3.5% of carbon (C), 1.9 to 2.3% of silicon (Si), 0.4 to 0.9% of manganese (Mn), 0.06 to 0.1% of sulfur (S), 0.06% or less of phosphorous (P), 0.6 to 0.8% of copper (Cu), 0.15 to 0.25% of molybdenum (Mo), and a remainder of iron (Fe) with respect to a total weight %; (ii) adding strontium (Sr) to the melted molten cast iron such that a ratio (S/Sr) of the content of the sulfur (S) to the content of the strontium (Sr) is in a range of 16 to 98; and (iii) tapping the molten cast iron in a ladle to put the tapped molten cast iron in a casting mold.

Here, an additive content of the strontium (Sr) may be preferably in a range of 0.001 to 0.005% with respect to a total weight of the molten cast iron.

According to one example of the present disclosure, the molten cast iron of the step (i) may be manufactured by adding 0.6 to 0.8% of copper (Cu) and 0.15 to 0.25% of molybdenum (Mo) to molten cast iron manufactured by melting a cast iron material that includes 3.2 to 3.5% of carbon (C), 1.9 to 2.3% of silicon (Si), 0.4 to 0.9% of manganese (Mn), 0.06 to 0.1% of sulfur (S), 0.06% or less of phosphorous (P), and a remainder of iron (Fe) with respect to a total weight % in a blast furnace.

Further, according to one example of the present disclosure, Fe—Si-based inoculant may be added in tapping the molten cast iron in the ladle.

Furthermore, another exemplary embodiment of the present disclosure provides flake graphite cast iron manufactured by the aforementioned manufacturing method, preferably, flake graphite cast iron for engine cylinder block and engine cylinder head.

Here, the flake graphite cast iron comprises 3.2 to 3.5% of carbon (C), 1.9 to 2.3% of silicon (Si), 0.4 to 0.9% of manganese (Mn), 0.06 to 0.1% of sulfur (S), 0.06% or less of phosphorous (P), 0.6 to 0.8% of copper (Cu), 0.15 to 0.25% of molybdenum (Mo), 0.001 to 0.005% of strontium (Sr), and a remainder of iron (Fe) that satisfies 100% with respect to a total weight %, and has a chemical composition such that a ratio (S/Sr) of the content of the sulfur (S) to the content of the strontium (Sr) is in a range of 16 to 98.

According to one example of the present disclosure, when carbon equivalent (CE) of the flake graphite cast iron is calculated by a method of CE=% C+% Si/3, the carbon equivalent (CE) may be in a range of 3.80 to 4.27.

Further, according to one example of the present disclosure, tensile strength of the flake graphite cast iron may be 300 to 350 MPa, and a Brinell hardness value (BHW) may be in a range of 200 to 230.

Meanwhile, according to one example of the present disclosure, in the flake graphite cast iron, a chill depth of a wedge test piece may be 3 mm or less.

Moreover, in the flake graphite cast iron, a length of a spiral of a fluidity test piece may be 730 mm or more.

Still another exemplary embodiment of the present disclosure provides an engine body for an internal combustion engine which includes an engine cylinder block or an engine cylinder head which is made of the aforementioned flake graphite cast iron, or both of the engine cylinder block and the engine cylinder head.

Here, the engine cylinder block or the engine cylinder head may have a thin walled part having a cross-section thickness of 5 mm or less and a thick walled part having a cross-section thickness of more than 10 mm, and a graphite type of the thin walled part may be a A+B type.

According to the present disclosure, the tensile strength, chill depth and fluidity may be changed depending on the ratio (S/Sr) between the additive contents of the sulfur (S) and the strontium (Sr), and the S/Sr ratio is controlled to be in the range of 16 to 98 in order to apply the flake graphite cast iron to the high-strength engine cylinder block and engine cylinder head in which a shape thereof is complicated and the thick walled part and the thin walled part simultaneously exist.

As stated above, according to the present disclosure, since the content of the strontium (Sr) and the ratio (S/Sr) of the content of the sulfur (S) to the content of the strontium (Sr) are precisely controlled, it is possible to provide flake graphite cast iron which has a high tensile strength of 300 to 350 MPa and excellent processibility and fluidity even though ferroalloy such as Cu or Mo is added and is appropriately used for engine components of an internal combustion engine, and a method for manufacturing the same.

Figure 1:
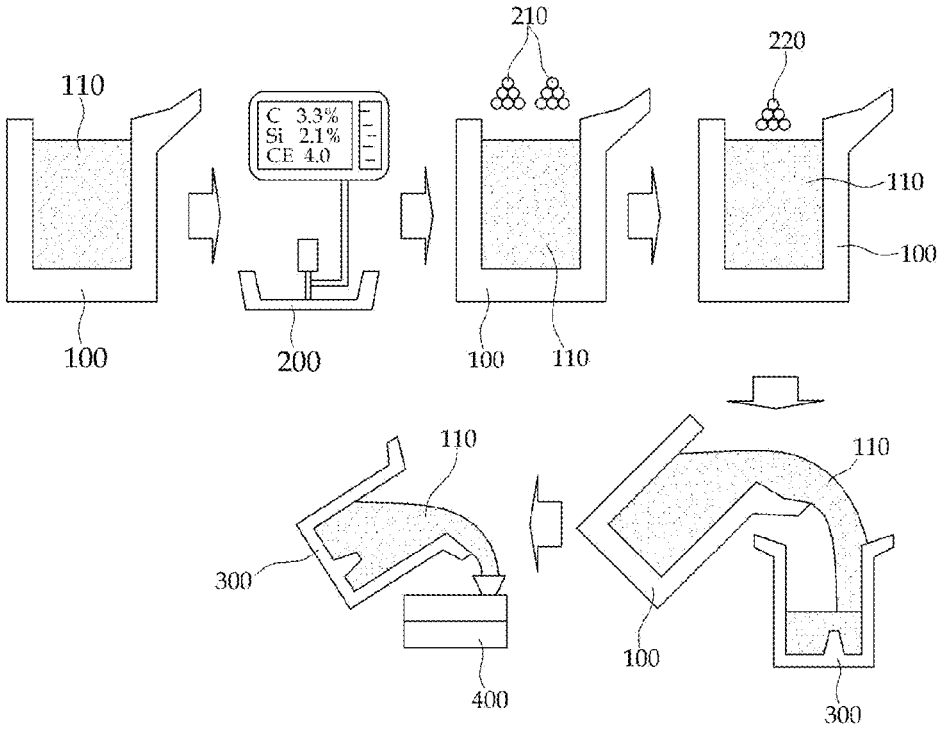
FIG. 1 briefly illustrates an example of a process of manufacturing high-strength flake graphite cast iron for engine cylinder block and engine cylinder head according to the present disclosure.

| Description of Main Reference Numerals of Drawings | |
|---|---|
| 1: Engine cylinder block | 2: Thin walled part having cross-section of 5 mm or less |
| 100: Blast furnace | 110: Molten Cast iron |
| 210: Copper, Molybdenum | 220: Strontium |
| 300: Ladle | 400: Mold |

DETAILED DESCRIPTION

Hereinafter, the present disclosure will be described in detail in connection with concrete examples.

In the present disclosure, a very small amount of strontium (Sr) is used as a component of cast iron. When a content ratio (S/Sr) between sulfur (S) and strontium (Sr) in the cast iron is controlled to be in a predetermined range, the strontium (Sr) reacts with the sulfur (S), and sulfide is formed. The formed sulfide serves as a nucleation site of flake graphite to suppress an occurrence of a chill and to assist growth and cystallization of useful A type flake graphite, so that it is possible to achieve high-strength and excellent processibility and fluidity.

At this time, the content of the added strontium (Sr) and the content ratio (S/Sr) between the strontium (Sr) and the sulfur (S) in the cast iron are the most important factors in manufacturing high-strength flake graphite cat iron having a tensile strength of 300 MPa or more. Accordingly, it is necessary to limit the flake graphite cast iron of the present disclosure to a manufacturing method and a corresponding chemical composition exemplified herein.

Hereinafter, a method for manufacturing flake graphite cast iron and a chemical composition of the manufactured flake graphite cast iron according to the present disclosure will be described. However, the present disclosure is not limited to the following manufacturing method, and the manufacturing method may be performed by modifying steps of the respective processes or selectively combining the steps when necessary.

Here, an additive content of each element is weight %, and is simply expressed as % in the following description.

Referring to FIG. 1, molten cast iron 110 that includes 3.2 to 3.5% of carbon (C), 1.9 to 2.3% of silicon (Si), 0.4 to 0.9% of manganese (Mn), 0.06 to 0.1% of sulfur (S), 0.06% or less of phosphorous (P), 0.6 to 0.8% of copper (Cu), 0.15 to 0.25% of molybdenum (Mo), and a remainder of iron (Fe) with respect to a total weight % is manufactured.

The method for manufacturing the molten cast iron 110 according to the present disclosure is not particularly limited. For example, a cast iron material having carbon (C), silicon (Si), manganese (Mn), sulfur (S) and phosphorous (P) which are five elements of the cast iron with the aforemention content range is melted in a blast furnace to manufacture molten cast iron, and ferroalloy 210 such as copper (Cu) or molybdenum (Mo) is added to the molten cast iron to prepare the molten cast iron 110 having the aforementioned chemical composition.

At this time, the phosphorous (P) may be included in a raw material for casting as an impurity, or may be separately added. Meanwhile, in the present disclosure, since the reason why the chemical composition of the molten cast iron is limited is the same as a reason described for a chemical composition of flake graphite cast iron to be described below, description thereof will not be presented.

Strontium (Sr) 220 is added to the molten cast iron 110 melted as described above, and the strontium is added such that a ratio (S/Sr) of the content of the sulfur (S) to the content of the strontium (Sr) is in a range of 16 to 98. At this time, the additive content of the strontium (Sr) 220 is preferably in a range of 0.001 to 0.005% with respect to the total weight % of the molten cast iron.

In the present disclosure, it is required that the chemical composition of the flake graphite cast iron is limited to the aforementioned composition and the ratio (S/Sr) of the content of the sulfur (S) to the content of the strontium (Sr) is limited to the range of 16 to 98. When the S/Sr ratio is out of the above-mentioned range, since hardness is increased, processibility may be degraded. In this way, by limiting the S/Sr ratio, even though the ferroalloy such as copper (Cu) or molybdenum (Mo) which is an element for strengthening matrix and stabilizing carbide is added in order to manufacture high-strength flake graphite cast iron, it is possible to obtain A+B type flake graphite. Further, since the occurrence of the chill is reduced, it is possible to obtain high-strength flake graphite cast iron for engine cylinder block and engine cylinder head having a tensile strength of 300 MPa or more and excellent processibility.

Component analysis of the molten cast iron 110 manufactured as described above is finished using a carbon equivalent measuring instrument, a carbon/sulfur analyzer and a spectrum analyzer.

Subsequently, the molten cast iron is tapped in a ladle 300 for tapping the molten cast iron, and Fe—Si-based inoculant is added simultaneously with the tapping in order to stabilize a material of the high-strength flake graphite cast iron. At this time, a size of the added inoculant may be a diameter in a range of 1 to 3 mm, and the added amount of the inoculant for obtaining an effect of stabilizing the material of the high-strength flake graphite cast iron is preferably limited to 0.3±0.05 weight %.

A molten temperature of the ladle in which the tapping have been finished is measured using an immersion thermometer, and after measuring the temperature, the molten cast iron 110 is put into a prepared casting mold 400 to finish the manufacturing of the high-strength flake graphite cast iron for engine cylinder block and engine cylinder head.

The high-strength flake graphite cast iron of the present disclosure manufactured as described above has a strength higher that of flake graphite cast iron having a tensile strength of about 250 MPa that is currently used for engine cylinder block and head and exhibits the same processibility as the currently used flake graphite cast iron. Further, even though the ferroalloy such as copper (Cu) or molybdenum (Mo) is added, it is less likely to cause the chill. In addition, the flake graphite cast iron of the present disclosure is applied to engine cylinder block and head having a complicated shape that simultaneously include a thick walled part having a cross-section thickness of 10 mm or more and a thin walled part having a cross-section thickness of 5 mm or less, a difference in content ratios of A+B graphites constituting the thick walled part and the thin walled part may be a cross-section ratio of less than 10%.

In the present disclosure, the high-strength flake graphite cast iron manufactured by the above-described method is provided. More specifically, the flake graphite cast iron comprises 3.2 to 3.5% of carbon (C), 1.9 to 2.3% of silicon (Si), 0.4 to 0.9% of manganese (Mn), 0.06 to 0.1% of sulfur (S), 0.06% or less of phosphorous (P), 0.6 to 0.8% of copper (Cu), 0.15 to 0.25% of molybdenum (Mo), 0.001 to 0.005% of strontium (Sr), and a remainder of iron (Fe) that satisfies 100% with respect to the total weight %, and has a chemical composition such that a ratio (S/Sr) of the content of sulfur (S) to the content of the strontium (Sr) is in a range of 16 to 98.

In the present disclosure, the reason why the respective components included in the flake graphite cast iron are added and the reaon why the ranges of the added contents are limited are as follows.

1) 3.2 to 3.5% of Carbon (C)

The carbon is an element that crystallizes useful flake graphite. In the flake graphite cast iron according to the present disclosure, when the content of the carbon (C) is less than 3.2%, A+B type flake graphite can be crystallized in the thick walled part having a cross-section thickness of 10 mm or more in the engine cylinder block and head, whereas since D+E type graphite which is unuseful flake graphite is crystallized in the thin walled part having a cross-section thickness of 5 mm or less in which a cooling speed is fast, it may be highly likely to cause the chill, and the processibility may be degraded. Furthermore, when the content of the carbon (C) exceeds 3.5%, since the flake graphite is excessively crystallized, the tensile strength is decreased, so that it is difficult to obtain the high-strength flake graphite cast iron. Accordingly, in order to prevent the aforementioned defect in high-strength engine cylinder blocks and heads having various thickness, the content of the carbon (C) is preferably limited to 3.2 to 3.5% in the present disclosure.

2) 1.9 to 2.3% of Silicon (Si)

When the silicon (Si) is added with an optimal ratio with respect to the carbon, it is possible to maximize the amount of crystallizing the flake graphite, the occurrence of the chill is decreased, and the strength is increased. In the flake graphite cast iron according to the present disclosure, when the content of the silicon (Si) is less than 1.9%, shirinkage defect is caused in a final solidified portion of the molten cast iron, and when the content thereof exceeds 2.3%, since the flake graphite is excessively crystallized, the tensile strength is decreased, so that it is difficult to obtain the high-strength flake graphite cast iron. Accordingly, in the present disclosure, the content of the silicon (Si) is preferably limited to 1.9 to 2.3%.

3) 0.4 to 0.9% of Manganese (Mn)

The manganese (Mn) is an element that allows an interlayer distance within pearlite to be densed to strengthen the matrix of the flake graphite cast iron. In the flake graphite cast iron according to the present disclosure, when the content of the manganese (Mn) is less than 0.4%, since the manganese does not largely affect the strengthening of the matrix, it is difficult to obtain the high-strength flake graphite cast iron. When the content of the manganese (Mn) exceeds 0.9%, since the carbide stabilizing effect further exhibits than the matrix strengthening effect, the occurrence of the chill is increased, so that the processibility may be deteriorated. Accordingly, in the present disclosure, the content of the manganese (Mn) is preferably limited to 0.4 to 0.9%.

4) 0.06 to 0.1% of Sulfur (S)

The sulfur (S) reacts with the very small amount of elements included in the molten cast iron to form the sulfide, and the sulfide serves as the nucleation site of the flake graphite to assist the growth of the flake graphite. In the flake graphite cast iron according to the present disclosure, in order to manufacture the high-strength flake graphite cast iron, the content of the sulfur (S) needs to be 0.06% or more. In addition, when the content of the sulfur (S) exceeds 0.1%, since brittleness of the material is increased, the content of the sulfur (S) according to the present disclosure is preferably limited to 0.06 to 0.1%.

5) 0.06% or Less of Phorphorus (P)

The phorphorus is a kind of impurity that is naturally added in a process of manufacturing cast iron in the air. The phorphorus (P) stabilizes pearlite, and reacts with the very small amount of elements included in the molten cast iron to form phoshide (steadite). Accordingly, the phorphorus serves to strengthen the matrix and improve wear resistance. However, when the content of the phorphorus (P) exceeds 0.06%, the brittleness is rapidly increased. Accordingly, in the present disclosure, the content of the phorphorus (P) is preferably limited to 0.06% or less. At this time, a lower limit of the content of the phorphorus (P) may exceed 0%, and is not particularly limited.

6) 0.6 to 0.8% of Copper (Cu)

The copper (Cu) is an element that strengthens the matrix of the flake graphite cast iron, and since the copper acts to prompt generation of the pearlite and to miniaturize the pearlite, the copper is a necessary element for securing the strength. In the high-strength flake graphite cast iron for engine cylinder block and head according to the present disclosure, when the content of the copper (Cu) is less than 0.6%, the tensile strength may be insufficient. Even when the content thereof exceeds 0.8%, since there is no effect obtained by an exceeding amount, material cost may be increased. Accordingly, in the present disclosure, the content of the copper (Cu) is preferably limited to 0.6 to 0.8%.

7) 0.15 to 0.25% of Molybdenum (Mo)

The molybdenum (Mo) is an element that strengthens the matrix of the flake graphite cast iron, improves the strength of the material, and improves the high-temperature strength. In the high-strength flake graphite cast iron for engine cylinder block and head according to the present disclosure, when the content of the molybdenum (Mo) is less than 0.15%, it may be difficult to obtain the tensile strength required in the present disclosure, and the high-temperature tensile strength applied to engine cylinder block and head having a high operation temperature may be insufficient. Meanwhile, when the content of the molybdenum (Mo) exceeds 0.25%, since a matrix strengthening effect is increased, the processibility is remarkably degraded as compared to the typically used flake graphite cast iron having a tensile strength of 250 MPa. Accordingly, in the present disclosure, the content of the molybdenum (Mo) is preferably limited to 0.15 to 0.25%.

8) 0.001 to 0.005% of Strontium (Sr)

The strontium (Sr) is a strong graphitization element that reacts with the sulfur (S) in being solidified even at a very small amount to form the sulfide, and forms a substrate on which the nucleus of the graphite can be grown to produce the useful A type graphite. In the present disclosure, in order to prevent the occurrence of the chill due to the addition of the ferroalloy such as Mo or Cu and to improve the strength by crystallizing useful flake graphite, the content of the strontium (Sr) needs to be 0.001% or more. However, since the strontuim (Sr) has a high oxidizing property, when 0.005% or more of strontium is added, the generation of the nucleus of the flake graphite is disturbed due to the oxidation to generate D+E type flake graphite and to cause the chill, so that the processibility may be degraded. Accordingly, in the present disclosure, the content of the strontium (Sr) is preferably limited to 0.001 to 0.005%.

9) Iron (Fe)

The iron is a main material of the cast iron according to the present disclosure. The remaining component other than the aforementioned components is iron (Fe), and other unavoidable impurities may be partially included.

The flake graphite cast iron of the present disclosure is limited to the above-described chemical composition, and the ratio (S/Sr) of the content of the sulfur (S) to the content of the strontium (Sr) is limited to the range of 16 to 98. Thus, even though the ferroalloy such as copper (Cu) or molybdenum (Mo) which is an element for strengthening the matrix and stabilizing the carbide is added in order to manufacture the high-strength flake graphite cast iron, it is possible to obtain the A+B type flake graphite. Further, since the occurrence of the chill is reduced, it is possible to obtain the high-strength flake graphite cast iron for engine cylinder block and head with a tensile strength of 300 MPa or more and excellent processibility.

According to one example of the present disclosure, when carbon equivalent (CE) of the flake graphite cast iron is calculated by the method of CE=% C+% Si/3, the carbon equivalent (CE) is allowed to be in a range of 3.80 to 4.27. When the carbon equivalent is less than 3.80, D+E type flake graphite is generated in the thin walled part having a cross-section thickness of 5 mm or less and the chill is caused, so that the producing defect may be caused and the processibility may be degraded. Further, when the carbon equivalent exceeds 4.27, the tensile strength may be decreased due to the excess crystallization of the process graphite. Accordingly, in the present disclosure, the carbon equivalent is preferably limited to the range of 3.80 to 4.27, and it is possible to appropriately control the carbon equivalent within such a range in order to control a quality and a mechanical property of the engine cylinder block and the head.

According to one example of the present disclosure, the tensile strength of the flake graphite cast iron having the aforementioned chemical composition is in a range of 300 to 350 MPa, and a Brinell hardness value (BHW) is about 200 to 230.

Figure 2:
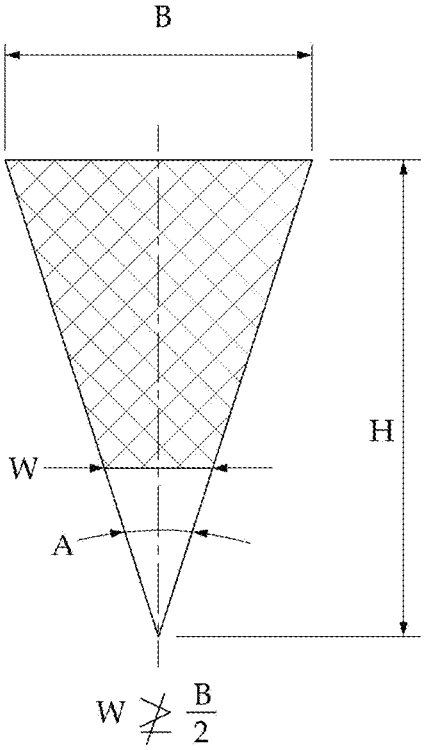
FIG. 2 illustrates a wedge test piece for measuring a chill depth of the flake graphite cast iron according to the present disclosure.

According to an example of the present disclosure, a chill depth of a wedge test piece to which the flake graphite cast iron having the aforementioned chemical composition is applied is 3 mm or less. At this time, the wedge test piece for measuring the chill depth may be illustrated as in FIG. 2.

Figure 3:
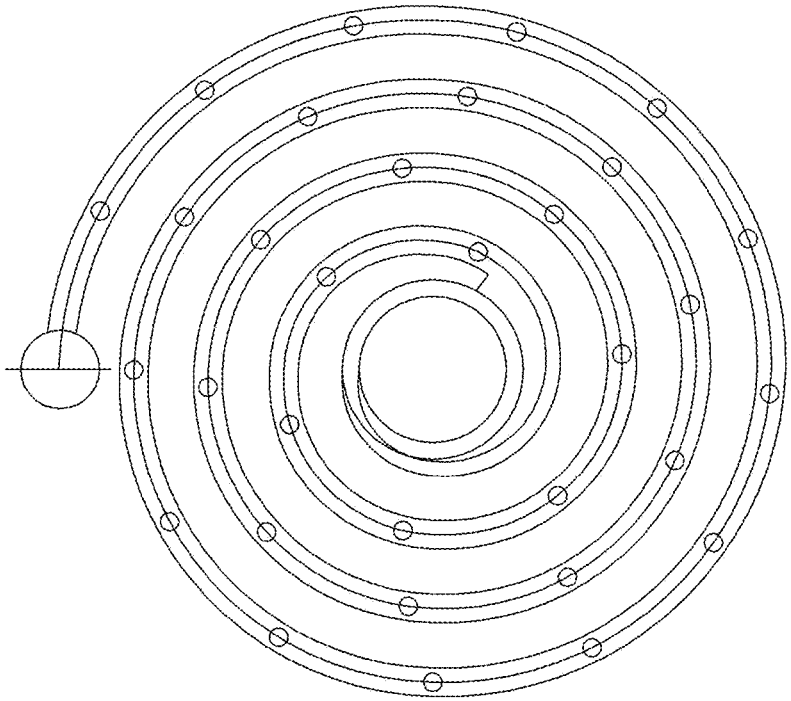
FIG. 3 illustrates a mold for manufacturing a spiral test piece for measuring fluidity of the flake graphite cast iron according to the present disclosure.
Figure 4:
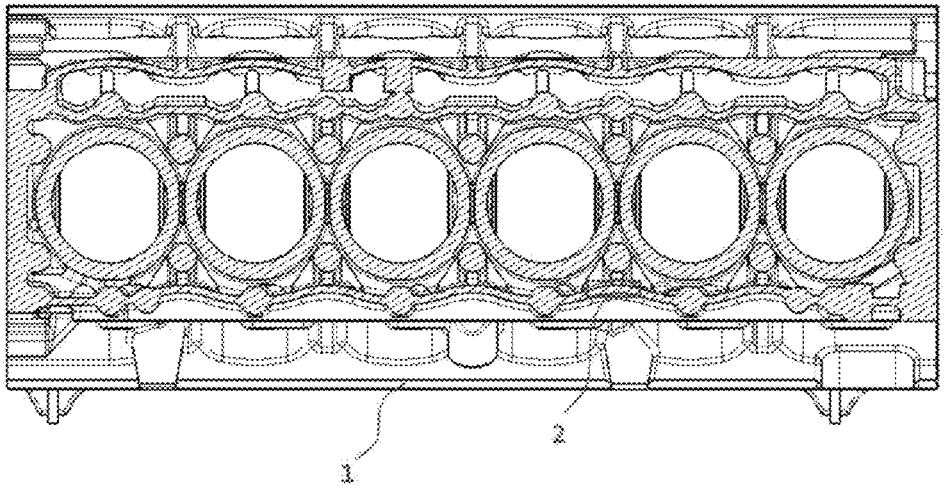
FIG. 4 is a plane cross-sectional view illustrating a thin walled part in a cylinder block according to the present disclosure.
Figure 5:
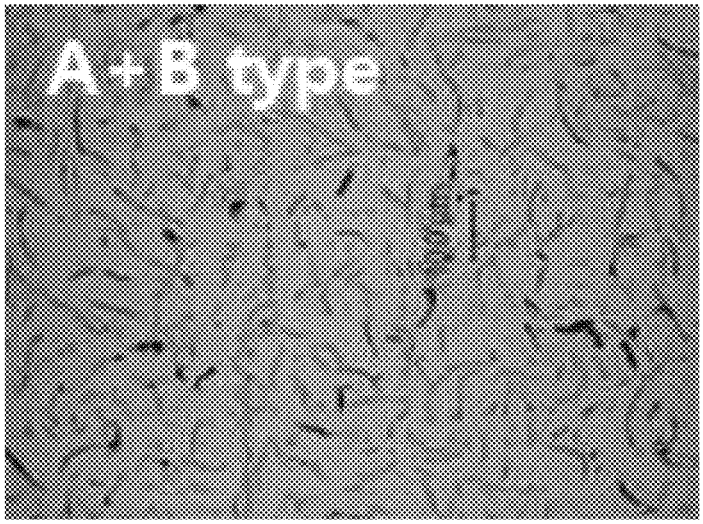
FIG. 5 is a photograph illustrating a surface structure of a thin walled part to which flake graphite cast iron of Embodiment 1 is applied to the cylinder block.
Figure 6:
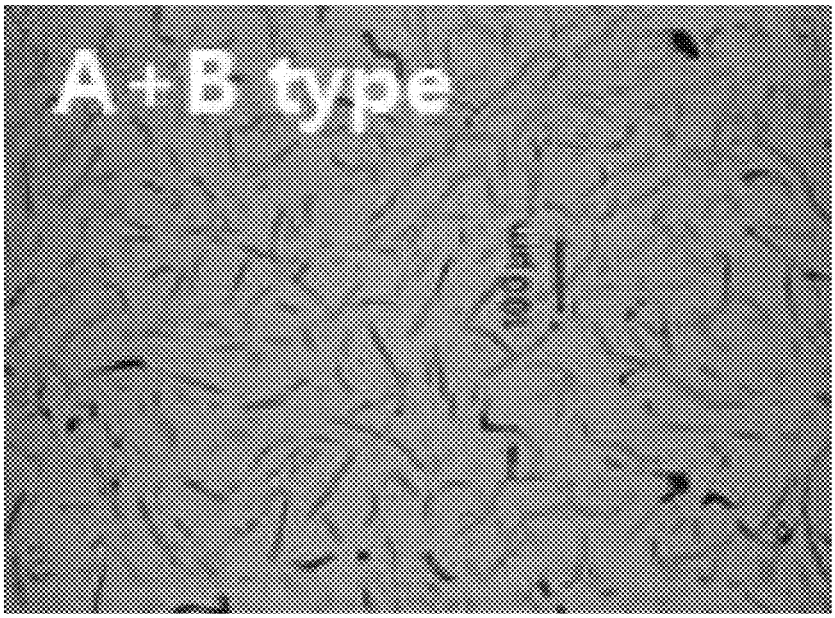
FIG. 6 is a photograph illustrating a surface structure of a thin walled part to which flake graphite cast iron of Embodiment 2 is applied to the cylinder block.
Figure 7:
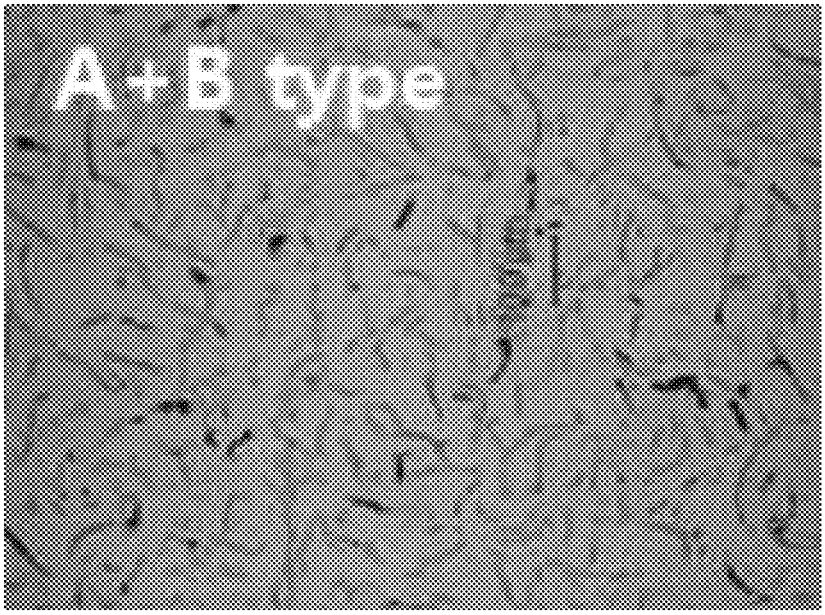
FIG. 7 is a photograph illustrating a surface structure of a thin walled part to which flake graphite cast iron of Embodiment 3 is applied to the cylinder block.
Figure 8:
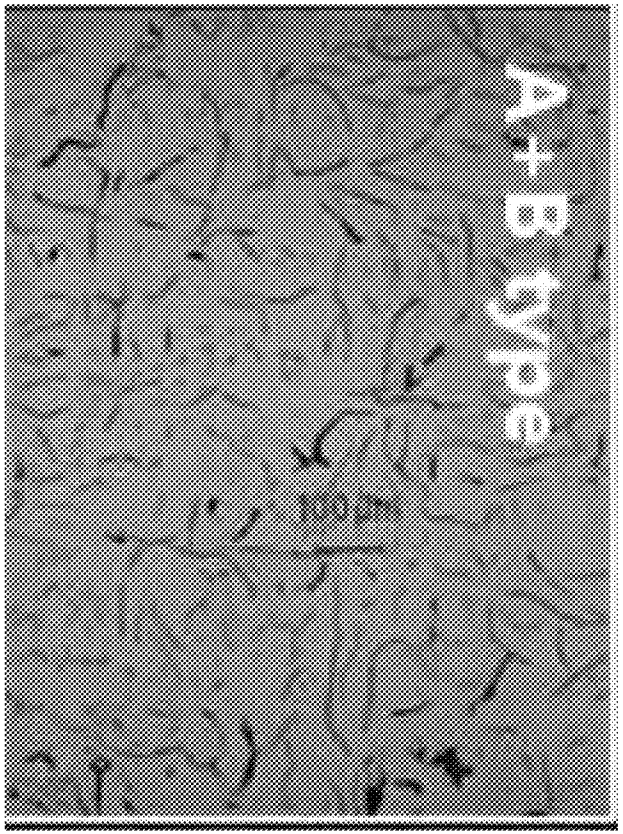
FIG. 8 is a photograph illustrating a surface structure of a thin walled part to which flake graphite cast iron of Embodiment 4 is applied to the cylinder block.
Figure 9:
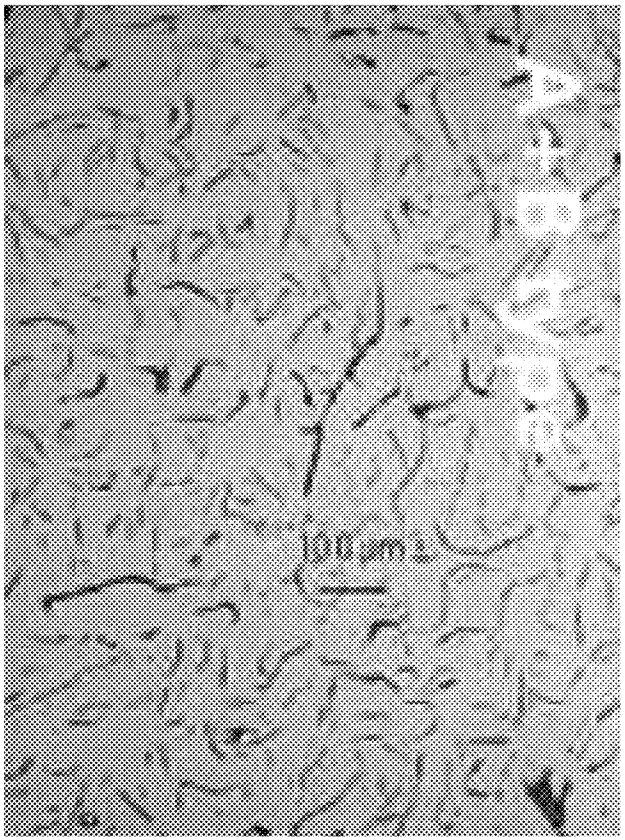
FIG. 9 is a photograph illustrating a surface structure of a thin walled part to which flake graphite cast iron of Embodiment 5 is applied to the cylinder block.
Figure 10:
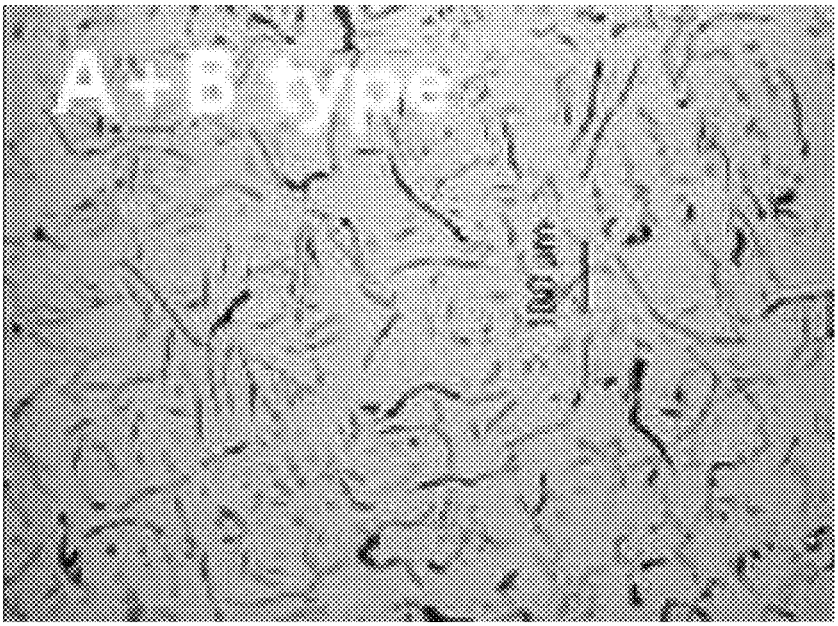
FIG. 10 is a photograph illustrating a surface structure of a thin walled part to which flake graphite cast iron of Embodiment 6 is applied to the cylinder block.
Figure 11:
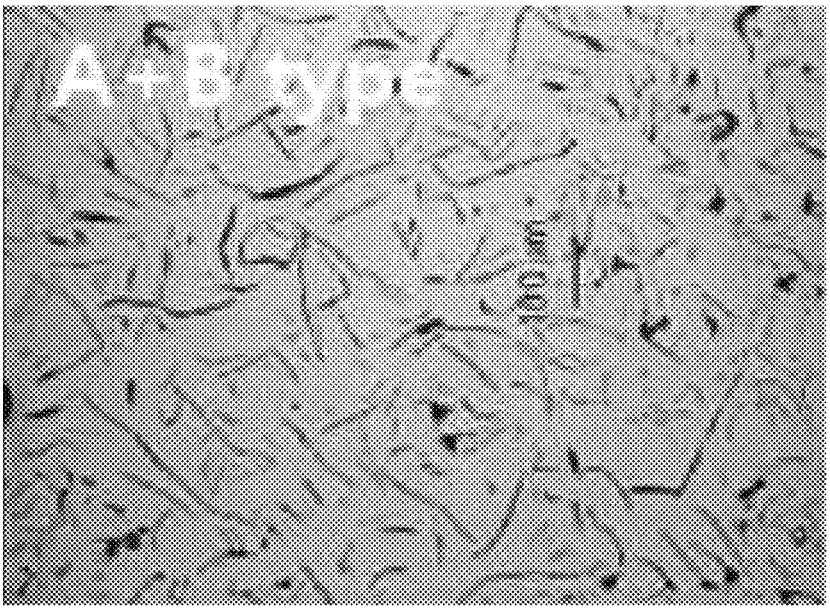
FIG. 11 is a photograph illustrating a surface structure of a thin walled part to which flake graphite cast iron of Embodiment 7 is applied to the cylinder block.
Figure 12:
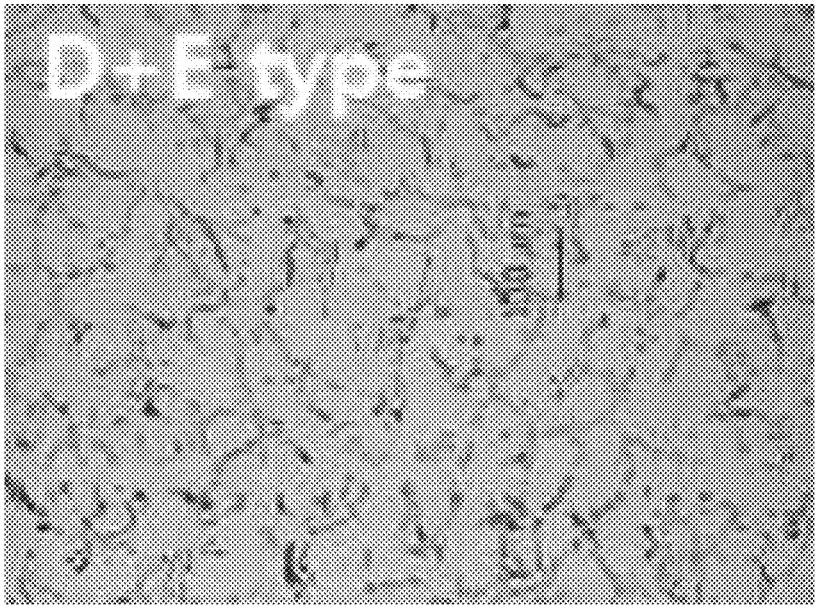
FIG. 12 is a photograph illustrating a surface structure of a thin walled part to which flake graphite cast iron of Comparative Example 1 is applied to the cylinder block.
Figure 13:
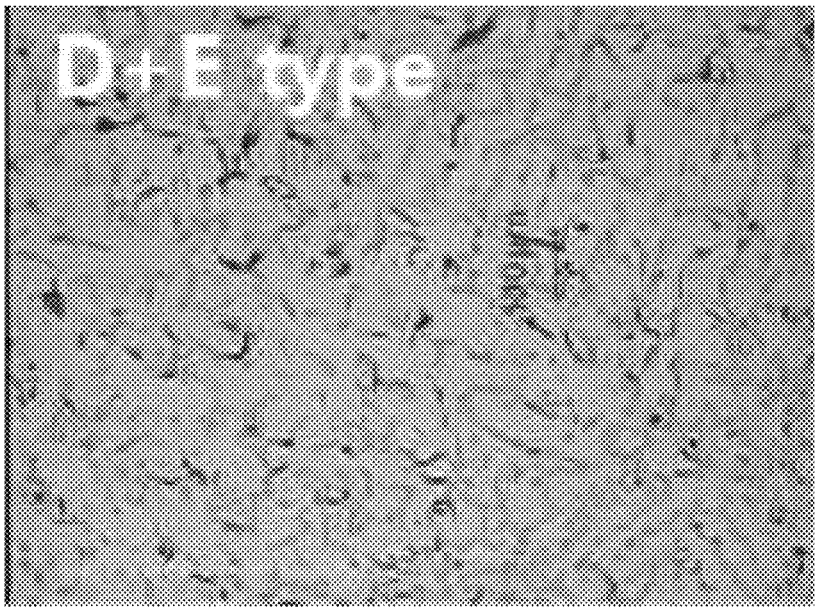
FIG. 13 is a photograph illustrating a surface structure of a thin walled part to which flake graphite cast iron of Comparative Example 2 is applied to the cylinder block.
Figure 14:
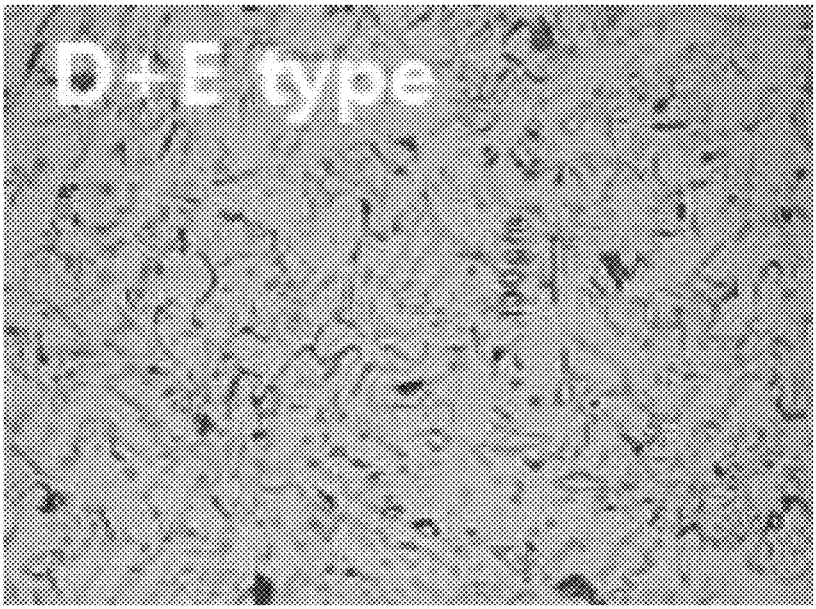
FIG. 14 is a photograph illustrating a surface structure of a thin walled part to which flake graphite cast iron of Comparative Example 3 is applied to the cylinder block.
Figure 15:
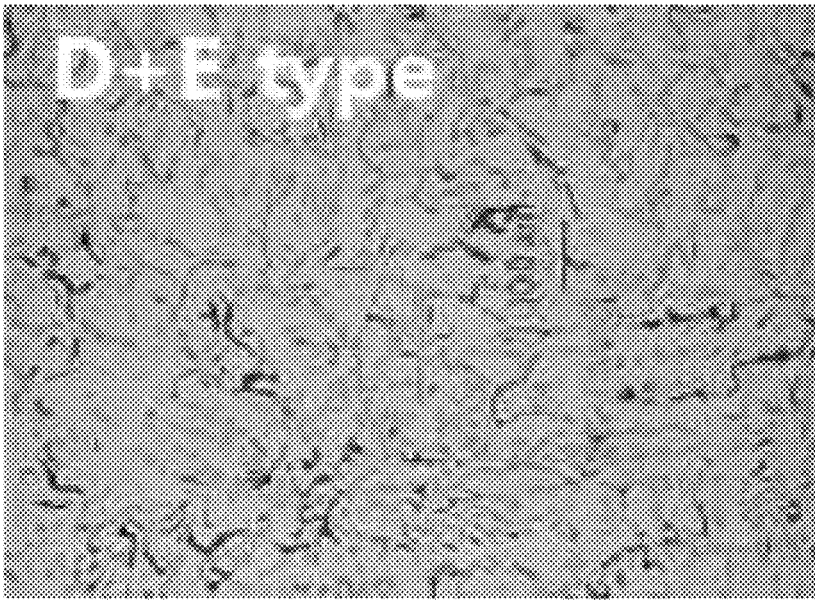
FIG. 15 is a photograph illustrating a surface structure of a thin walled part to which flake graphite cast iron of Comparative Example 4 is applied to the cylinder block.
Figure 16:
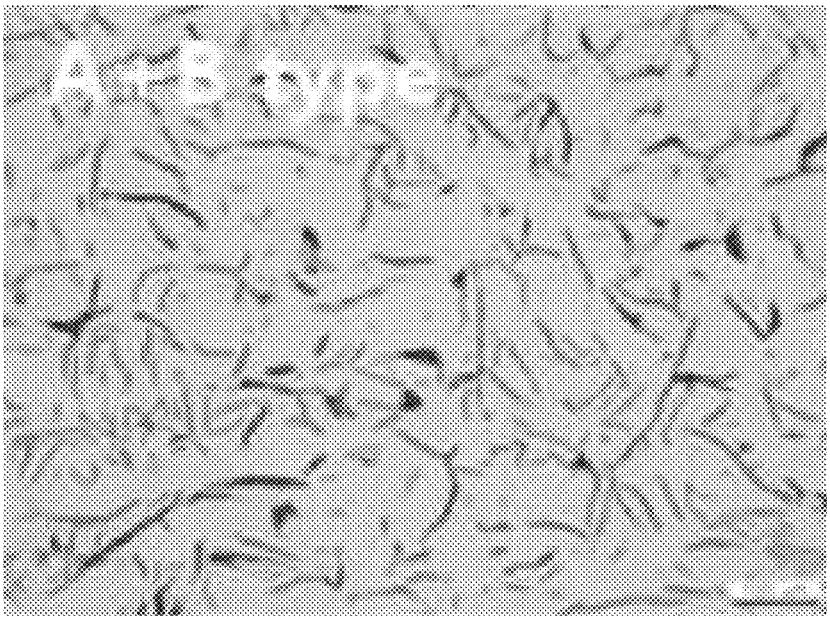
FIG. 16 is a photograph illustrating a surface structure of a thin walled part to which flake graphite cast iron of Comparative Example 5 is applied to the cylinder block.
Figure 17:
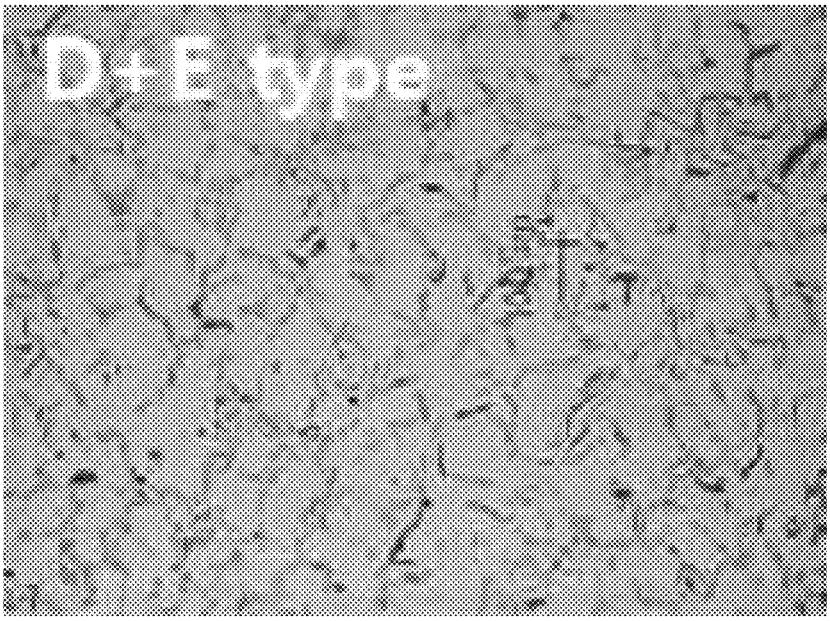
FIG. 17 is a photograph illustrating a surface structure of a thin walled part to which flake graphite cast iron of Comparative Example 6 is applied to the cylinder block.

Furthermore, according to one example of the present disclosure, a length of a spiral of a fluidity test piece to which the flake graphite cast iron having the aforementioned chemical composition is applied may be 730 mm or more. At this time, the fluidity test piece may be illustrated as in FIG. 3, and an upper limit of the length of the spiral of the fluidity test piece is not particularly limited. As one example, the upper limit may be an end point of the length of the spiral of the fluidity test piece standard.

In addition, since the flake graphite cast iron of the present disclosure is a high-strength material having a tensile strength of 300 MPa or more, the flake graphite cast iron can be applied to an engine body for an internal combustion engine, particularly, an engine cylinder head or an engine cylinder block in which a shape thereof is complicated and the thick walled part and the thin walled part simultaneously exist, or both of them.

Referentially, terms to be described below are terms set in consideration of functions in the present disclosure, and may be changed depending on an intension of a manufacturer or a precedent. Thus, the terms should be defined based on contents described in the present specification. For example, the engine body in the present disclosure means a configuration of an engine including an engine cylinder block, an engine cylinder head, and a head cover.

The engine cylinder block and/or the engine cylinder head to which the flake graphite cast iron according to the present disclosure is applied as a material has a thin walled part having a cross-section thickness of 5 mm or less and a thick walled part having a cross-section thickness of 10 mm or more, and a graphite type of the thin walled part is preferably A+B type. Actually, it can be seen that all of the thin walled parts of the cylinder blocks to which the flake graphite cast iron of the present disclosure is applied are A+B type graphite (see FIGS. 5 to 11).

Hereinafter, the embodiments of the present disclosure will be described in more detail. However, the following embodiments are presented to help understanding of the present disclosure, and are not intended to limit the scope of the present disclosure. It is possible to change or modify the embodiments without departing from the spirit of the present disclosure.

<Embodiments 1 to 7 and Comparative Examples 1 to 6>

Flake graphite cast irons are manufactured according to Embodiments 1 to 7 and Comparative Examples 1 to 6 on the basis of compositions of Table 1.

TABLE 1

| Category | C | Si | Mn | S | P | Cu | Mo | Sr | S/Sr | Other components | Fe |
|---|---|---|---|---|---|---|---|---|---|---|---|
| Embodiment 1 | 3.24 | 2.17 | 0.62 | 0.085 | 0.030 | 0.68 | 0.18 | 0.0024 | 35 | | Remainder |
| Embodiment 2 | 3.38 | 2.07 | 0.62 | 0.086 | 0.028 | 0.63 | 0.19 | 0.003 | 29 | | Remainder |
| Embodiment 3 | 3.42 | 2.11 | 0.71 | 0.065 | 0.041 | 0.71 | 0.23 | 0.004 | 16 | | Remainder |
| Embodiment 4 | 3.27 | 1.99 | 0.69 | 0.091 | 0.031 | 0.65 | 0.21 | 0.0021 | 43 | | Remainder |
| Embodiment 5 | 3.26 | 2.21 | 0.81 | 0.071 | 0.045 | 0.74 | 0.20 | 0.0035 | 20 | | Remainder |
| Embodiment 6 | 3.22 | 2.19 | 0.77 | 0.093 | 0.030 | 0.70 | 0.19 | 0.0013 | 71 | | Remainder |
| Embodiment 7 | 3.31 | 2.09 | 0.75 | 0.098 | 0.030 | 0.70 | 0.19 | 0.0010 | 98 | | Remainder |
| Comparative Example 1 | 3.25 | 2.19 | 0.65 | 0.15 | 0.027 | 0.69 | 0.22 | 0.0014 | 107 | | Remainder |
| Comparative Example 2 | 3.29 | 2.22 | 0.73 | 0.045 | 0.022 | 0.69 | 0.19 | 0.0047 | 9 | | Remainder |
| Comparative Example 3 | 3.31 | 2.10 | 0.72 | 0.082 | 0.030 | 0.72 | 0.18 | 0.0008 | 103 | | Remainder |

TABLE 1-continued

| Category | C | Si | Mn | S | P | Cu | Mo | Sr | S/Sr | Other components | Fe |
|---|---|---|---|---|---|---|---|---|---|---|---|
| Comparative Example 4 | 3.33 | 2.09 | 0.64 | 0.080 | 0.021 | 0.73 | 0.22 | 0.0075 | 10 | | Remainder |
| Comparative Example 5 | 3.28 | 1.95 | 0.67 | 0.053 | 0.030 | — | — | — | — | 0.07% Sn 0.2% Cr | Remainder |
| Comparative Example 6 | 3.23 | 2.12 | 0.70 | 0.092 | 0.028 | 0.45 | — | — | — | 0.07% Sn 0.036 Cr | Remainder |

Firstly, initial molten metal including carbon (C), silicon (Si), manganese (Mn), sulfur (S) and phosphorus (P) on the basis of the composition of Table 1 is prepared. The phosphorus (P) is an impurity included in a raw material for casting, and the content thereof is adjusted to be 0.06% or less without separately adding the phosphorus.

Before tapping, carbon equivalent (CE) is measured using a carbon equivalent measuring instrument, and the content of the carbon (C) is controlled to be 3.2 to 3.5%. Ferroalloy such as copper (Cu) or molybdenum (Mo) is controlled to be the same compositions as those represented in Table 1. After the strontium (Sr) is added to finish the melting, the tapping is performed. At this time, Fe—Si-based inoculant is input simultaneously with the tapping. After the tapping is finished in the ladle, a temperature of the molten cast iron is measured, and the molten cast iron is put into a prepared casting mold. Thus, flake graphite cast iron products for engine cylinder block and engine cylinder head are manufactured.

Carbon equivalent, tensile strength, Brinell hardness and chill depth of cast irons manufactured according to Embodiments 1 to 7 and Comparative Examples 1 to 6 on the basis of the compositions of Table 1 are respectively measured and represented in Table 2.

TABLE 2

| Category | Carbon Equivalent (C.E.) | Tensile Strength ($N/mm^2$) | Hardness (HBW) | Chill depth (mm) | Fluidity (mm) |
|---|---|---|---|---|---|
| Embodiment 1 | 3.96 | 331 | 224 | 0 | 788 |
| Embodiment 2 | 4.07 | 315 | 220 | 0 | 761 |
| Embodiment 3 | 4.12 | 322 | 224 | 0 | 791 |
| Embodiment 4 | 3.93 | 331 | 224 | 1 | 782 |
| Embodiment 5 | 3.99 | 325 | 217 | 0 | 774 |
| Embodiment 6 | 3.95 | 315 | 217 | 0 | 765 |
| Embodiment 7 | 4.01 | 318 | 210 | 0 | 770 |
| Comparative Example 1 | 3.98 | 290 | 243 | 6 | 689 |
| Comparative Example 2 | 4.03 | 341 | 241 | 4 | 711 |
| Comparative Example 3 | 4.01 | 287 | 243 | 5 | 701 |
| Comparative Example 4 | 4.02 | 315 | 243 | 4 | 722 |
| Comparative Example 5 | 3.93 | 270 | 210 | 0 | 845 |
| Comparative Example 6 | 3.93 | 304 | 234 | 4 | 759 |

As can be seen from Table 2, tensile strengths of the cast irons according to Embodiments 1 to 7 whose ratio (S/Sr) is controlled to be in the range of 16 to 98 are in a range of 300 to 350 MPa, and Brinel hardness values are in a range of 200 to 230 HBW. Moreover, it can be seen that chill depths is 3 mm or less and length of spirals of fluidity test pieces are 730 mm or more.

Further, except for Comparative Example 5 whose tensile strength is 250 MPa, Comparative Examples 1 to 4 and 6 are in D+E type graphite types, whereas thin walled parts to which the flake graphite cast irons of Embodiments 1 to 7 are applied are all in A+B type graphite types (See FIGS. 5 to 17).

Referentially, the cast irons of Comparative Examples 1 and 2 have the same contents as those of the compositions of Embodiments 1 to 7, and are manufactured by the same manufacturing process as that in Comparative Examples 1 and 2. However, the content of the sulfur (S) and the S/Sr ratio are out of the composition range of the present disclosure.

Comparative Examples 3 and 4 have the same contents at those of the compositions of Embodiments 1 to 7, and are manufactured by the same manufacturing process as that in Embodiments 1 to 7. However, the content of the strontium (Sr) and the S/Sr ratio are out of the composition range of the present disclosure.

Comparative Example 5 is a material having a tensile strength of 250 MPa that is commercially available as flake graphite cast iron for engine cylinder block and head according to the related art.

Comparative Example 6 is a material in which only ferroalloy is simply added to a material having a tensile strength of 250 MPa that is conventionally used to manufacture high-strength flake graphite cast iron for engine cylinder block and head.

As a result, since the high-strength flake graphite cast iron according to the present disclosure has a stable tensile strength, hardness, chill depth, and fluidity, it is possible to usefully apply the high-strength flake graphite cast iron to the engine cylinder block and engine cylinder head requiring high strength.

Although the present disclosure has been described with reference to exemplary and preferred embodiments, workers skilled in the art will recognize that changes may be made in form and detail without departing from the spirit and scope of the disclosure.

The invention claimed is:

1. A method for manufacturing a high-strength flake graphite cast iron for an engine body, the method comprising:

(i) manufacturing molten cast iron that consists of 3.2 to 3.5% of carbon (C), 1.9 to 2.3% of silicon (Si), 0.62 to 0.9% of manganese (Mn), 0.06 to 0.1% of sulfur (S), 0.06% or less of phosphorous (P), 0.6 to 0.8% of copper (Cu), 0.15 to 0.25% of molybdenum (Mo), and a remainder of iron (Fe) and other unavoidable impurities with respect to a total weight %;

(ii) adding 0.001 to 0.005% of strontium (Sr) to the melted molten cast iron based on a total weight of the molten cast iron, wherein a ratio (S/Sr) of the content of the sulfur (S) to the content of the strontium (Sr) is adjusted into a range of 16 to 98; and (iii) tapping the molten cast iron in a ladle to put the tapped molten cast iron in a casting mold, wherein a chill depth of a wedge test piece manufactured using the flake graphite cast iron is 3 mm or less.

2. The method of claim 1, wherein the molten cast iron of the step (i) is manufactured by adding 0.6 to 0.8% of copper (Cu) and 0.15 to 0.25% of molybdenum (Mo) to molten cast iron manufactured by melting a cast iron material that consists of 3.2 to 3.5% of carbon (C), 1.9 to 2.3% of silicon (Si), 0.62 to 0.9% of manganese (Mn), 0.06 to 0.1% of sulfur (S), 0.06% or less of phosphorous (P), and a remainder of iron (Fe) and other unavoidable impurities with respect to a total weight % in a blast furnace.

3. The method of claim 1, wherein Fe-Si-based inoculant is added in the step (iii) of tapping the molten cast iron in the ladle.

4. A flake graphite cast iron for an engine body which consists of 3.2 to 3.5% of carbon (C), 1.9 to 2.3% of silicon (Si), 0.62 to 0.9% of manganese (Mn), 0.06 to 0.1% of sulfur (S), 0.06% or less of phosphorous (P), 0.6 to 0.8% of copper (Cu), 0.15 to 0.25% of molybdenum (Mo), 0.001 to 0.005% of strontium (Sr), and a remainder of iron (Fe) and other unavoidable impurities that satisfies 100% with respect to a total weight %, and simultaneously satisfies a chemical composition wherein a ratio (S/Sr) of the content of the sulfur (S) to the content of the strontium (Sr) is in a range of 16 to 98, wherein a chill depth of a wedge test piece is 3 mm or less.

5. The flake graphite cast iron of claim 4, wherein tensile strength is 300 to 350 MPa.

6. The flake graphite cast iron of claim 4, wherein a Brinell hardness value (BHW) is 200 to 230.

7. The flake graphite cast iron of claim 4, wherein a length of a spiral of a fluidity test piece is 730 mm or more.

8. The flake graphite cast iron of claim 4, wherein carbon equivalent (CE) is in a range of 3.80 to 4.27.

9. An engine body for an internal combustion engine which includes an engine cylinder block or an engine cylinder head which is made of the flake graphite cast iron of claim 4, or both of the engine cylinder block and the engine cylinder head.

10. The engine body for an internal combustion engine of claim 9, wherein the engine cylinder block or the engine cylinder head has a thin walled part having a cross-section thickness of 5 mm or less and a thick walled part having a cross-section thickness of more than 5 mm, and a graphite type of the thin walled part is a A+B type.

* * * * *